US006864025B2

(12) United States Patent
Law et al.

(10) Patent No.: US 6,864,025 B2
(45) Date of Patent: Mar. 8, 2005

(54) SULFONYLDIPHENYLENE-BASED CHARGE TRANSPORT COMPOSITIONS

(75) Inventors: Kam W. Law, Woodbury, MN (US); Nusrallah Jubran, St. Paul, MN (US); Zbigniew Tokarski, Woodbury, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 164 days.

(21) Appl. No.: 10/385,148

(22) Filed: Mar. 10, 2003

(65) Prior Publication Data

US 2003/0203296 A1 Oct. 30, 2003

Related U.S. Application Data

(60) Provisional application No. 60/368,297, filed on Mar. 28, 2002, and provisional application No. 60/368,256, filed on Mar. 28, 2002.

(51) Int. Cl.[7] ..... G03G 5/047

(52) U.S. Cl. ..... 430/58.6; 430/58.45; 564/251

(58) Field of Search ..... 430/58.6, 58.45; 564/251

(56) References Cited

U.S. PATENT DOCUMENTS

| | | | | |
|---|---|---|---|---|
| 3,932,455 | A | 1/1976 | Bilofsky et al. | |
| 3,943,108 | A | 3/1976 | Teuscher | |
| 4,072,519 | A | 2/1978 | Pearson et al. | |
| 4,297,426 | A | 10/1981 | Sakai et al. | |
| 4,322,487 | A | 3/1982 | Merrill et al. | |
| 4,426,327 | A | 1/1984 | Hashimoto et al. | |
| 4,476,137 | A | 10/1984 | Haviv et al. | |
| 4,786,571 | A | 11/1988 | Ueda | |
| 4,957,838 | A | 9/1990 | Aruga et al. | |
| 5,128,227 | A | 7/1992 | Monbaliu et al. | |
| 5,274,116 | A | 12/1993 | Martin et al. | |
| 5,932,384 | A | 8/1999 | Mitsumori et al. | |
| 6,001,522 | A | 12/1999 | Woo et al. | |
| 6,020,096 | A | 2/2000 | Fuller et al. | |
| 6,030,734 | A | 2/2000 | Mitsumori | |
| 6,066,426 | A | 5/2000 | Mott et al. | |
| 6,099,996 | A | 8/2000 | Yanus et al. | |
| 6,140,004 | A | 10/2000 | Mott et al. | |
| 6,214,503 | B1 | 4/2001 | Gaidelis et al. | |
| 6,340,548 | B1 | 1/2002 | Jubran et al. | |
| 6,689,523 | B2 * | 2/2004 | Law et al. | 430/58.35 |
| 6,696,209 | B2 * | 2/2004 | Law et al. | 430/58.35 |
| 2002/0064397 | A1 | 5/2002 | Kellie et al. | |
| 2002/0122997 | A1 | 9/2002 | Lee et al. | |

FOREIGN PATENT DOCUMENTS

| | | |
|---|---|---|
| EP | 1 202 120 A2 | 5/2002 |

* cited by examiner

*Primary Examiner*—Mark A. Chapman

(57) ABSTRACT

This invention relates to a novel organophotoreceptor that includes:

(a) a charge transport composition comprising molecules having the formula where the average n is between 1 and 1000;

$R_1$, $R_2$, $R_3$, and $R_4$ are, independently, hydrogen, a branched or linear alkyl group (e.g., a $C_1$–$C_{30}$ alkyl group), a branched or linear unsaturated hydrocarbon group, an ether group, a cycloalkyl group (e.g. a cyclohexyl group), or an aryl group (e.g., a phenyl or naphthyl group);

X is a divalent carbazole group or a divalent biscarbazole alkane group;

Y is a divalent sulfonyldiphenylene group;

Z is $C(R_4)$—X—$C(R_3)$═O double-bonded to the adjacent N or two hydrogens where each hydrogen is independently single-bonded to the adjacent N; and Q is O or N—$N(R_1)$—Y—$N(R_2)$—$NH_2$;

(b) a charge generating compound; and (c) an electrically conductive substrate over which the charge transport composition and the charge generating compound are located.

18 Claims, No Drawings

SULFONYLDIPHENYLENE-BASED CHARGE TRANSPORT COMPOSITIONS

CROSS REFERENCE TO RELATED APPLICATIONS

The application claims priority to U.S. Provisional Patent Application Ser. No. 60/368,297 to Law et al., entitled "Electrophotographic Organophotoreceptors With Novel Polymeric Charge Transport Compounds," incorporated herein by reference and to U.S. Provisional Patent Application Ser. No. 60/368,256 to Law et al. entitled "Electrophotographic Organophotoreceptors With Novel Polymeric Charge Transport Compounds," both of which are filed on Mar. 28, 2002 and incorporated herein by reference.

FIELD OF INVENTION

This invention relates to organophotoreceptors suitable for use in electrophotography and, more specifically, to flexible organophotoreceptors having improved charge transport compositions comprising a N-alkyl-3,6-diformylcarbazole sulfonyldiphenylenebishydrazone group, and in some embodiments a polymer derived from corresponding repeating units of a N-alkyl-3,6-diformylcarbazole sulfonyl-diphenylenebishydrazone group.

BACKGROUND

In electrophotography, an organophotoreceptor in the form of a plate, disk, sheet, belt, drum or the like having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas, thereby forming a pattern of charged and uncharged areas. A liquid or solid toner is then deposited in either the charged or uncharged areas depending on the properties of the toner to create a toned image on the surface of the photoconductive layer. The resulting toned image can be transferred to a suitable receiving surface such as paper. The imaging process can be repeated many times to complete a single image and/or to reproduce additional images.

Both single layer and multilayer photoconductive elements have been used. In single layer embodiments, a charge transport material and charge generating material are combined with a polymeric binder and then deposited on the electrically conductive substrate. In multilayer embodiments, the charge transport material and charge generating material are in the form of separate layers, each of which can optionally be combined with a polymeric binder, deposited on the electrically conductive substrate. Two arrangements are possible. In one arrangement (the "dual layer" arrangement), the charge generating layer is deposited on the electrically conductive substrate and the charge transport layer is deposited on top of the charge generating layer. In an alternate arrangement (the "inverted dual layer" arrangement), the order of the charge transport layer and charge generating layer is reversed.

In both the single and multilayer photoconductive elements, the purpose of the charge generating material is to generate charge carriers (i.e., holes and/or electrons) upon exposure to light. The purpose of the charge transport composition is to accept at least one type of these charge carriers, generally holes, and transport them through the charge transport layer in order to facilitate discharge of a surface charge on the photoconductive element.

SUMMARY OF THE INVENTION

In a first aspect, the invention features an organophotoreceptor that includes:

(a) a charge transport composition comprising molecules having the formula

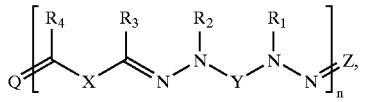

where the average n is between 1 and 1000;

$R_1$, $R_2$, $R_3$, and $R_4$ are, independently, hydrogen, a branched or linear alkyl group (e.g., a $C_1$–$C_{30}$ alkyl group), a branched or linear unsaturated hydrocarbon group, an ether group, a cycloalkyl group (e.g. a cyclohexyl group), or an aryl group (e.g., a phenyl or naphthyl group);

X is a divalent carbazole group or a divalent biscarbazole alkane group;

Y is a divalent sulfonyldiphenylene group;

Z is $C(R_4)$—X—$C(R_3)$═O double-bonded to the adjacent N or two hydrogens where each hydrogen is independently single-bonded to the adjacent N; and Q is O or N—$N(R_1)$—Y—$N(R_2)$—$NH_2$;

(b) a charge generating compound; and (c) an electrically conductive substrate over which the charge transport composition and the charge generating compound are located.

In a second aspect, the invention features an electrophotographic imaging apparatus that includes (a) a plurality of support rollers; and (b) the above-described organophotoreceptor operably coupled to said support rollers with motion of said support rollers resulting in motion of said organophotoreceptor. The apparatus can further include a liquid toner dispenser.

In a third aspect, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) contacting the surface with a liquid toner or dry toner to create a toned image; and (d) transferring the toned image to a substrate. In some embodiments, the toner is a liquid toner comprising a dispersion of colorant particles in an organic liquid In a fourth aspect, the invention features a novel charge transport composition comprising molecules having the formula

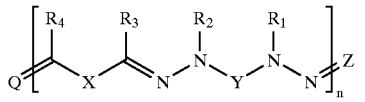

where the average n is between 1 and 1000;

$R_1$, $R_2$, $R_3$, and $R_4$ are, independently, hydrogen, a branched or linear alkyl group (e.g., a $C_1$–$C_{30}$ alkyl group), a branched or linear unsaturated hydrocarbon group, an ether group, a cycloalkyl group (e.g. a cyclohexyl group), or an aryl group (e.g., a phenyl or naphthyl group);

X is a divalent carbazole group or a divalent biscarbazole alkane group;

Y is a divalent sulfonyldiphenylene group;

Z is $C(R_4)—X—C(R_3)=O$ double-bonded to the adjacent N or two hydrogens where each hydrogen is independently single-bonded to the adjacent N; and Q is O or $N—N(R_1)—Y—N(R_2)—NH_2$.

These photoreceptors can be used successfully with liquid and dry toners to produce high quality images. The high quality of the images can be maintained after repeated cycling.

Other features and advantages of the invention will be apparent from the following description of the preferred embodiments thereof, and from the claims.

DETAILED DESCRIPTION

Charge transport compositions with desirable properties can be formed having a divalent sulfonyldiphenylene group bonded with a hydrazone group that is in turn bonded to a divalent carbazole group or a divalent biscarbazole alkane group. The resulting group has a sulfonyldiphenylene functional group and a carbazole functional group that can polymerize to form a corresponding polymer. These charge transport compositions have desirable properties as evidenced by their performance in organophotoreceptors for electrophotography. The organophotoreceptors are particularly useful in laser printers and the like as well as photocopiers, scanners and other electronic devices based on electrophotography. The use of these charge transport compositions is described in more detail below in the context of laser printer use, although their application in other devices operating by electrophotography can be generalized from the discussion below.

To produce high quality images, particularly after multiple cycles, it is desirable for the charge transport compositions to form a homogeneous solution with the polymeric binder and remain approximately homogeneously distributed through the organophotoreceptor material during the cycling of the material. In addition, it is desirable to increase the amount of charge that the charge transport composition can accept (indicated by a parameter known as the acceptance voltage or "$V_{acc}$"), and to reduce retention of that charge upon discharge (indicated by a parameter known as the discharge voltage or "$V_{dis}$").

There are many charge transport compositions available for electrophotography. Examples of charge transport compounds are pyrazoline derivatives, fluorene derivatives, oxadiazole derivatives, stilbene derivatives, hydrazone derivatives, carbazole hydrazone derivatives, polyvinyl carbazole, polyvinyl pyrene, or polyacenaphthylene. However, there is a need for other charge transport compositions to meet the various requirements of particular electrophotography applications.

In electrophotography applications, a charge generating compound within an organophotoreceptor absorbs light to form electron-hole pairs. These electron-hole pairs can be transported over an appropriate time frame under a large electric field to discharge locally a surface charge that is generating the field. The discharge of the field at a particular location results in a surface charge pattern that essentially matches the pattern drawn with the light. This charge pattern then can be used to guide toner deposition. The charge transport compositions described herein are especially effective at transporting charge, and in particular holes from the electron-hole pairs formed by the charge generating compound. In some embodiments, a specific electron transport compound can also be used along with the charge transport composition.

The layer or layers of materials containing the charge generating compound and the charge transport compositions are within an organophotoreceptor. To print a two dimensional image using the organophotoreceptor, the organophotoreceptor has a two dimensional surface for forming at least a portion of the image. The imaging process then continues by cycling the organophotoreceptor to complete the formation of the entire image and/or for the processing of subsequent images.

The organophotoreceptor may be provided in the form of a plate, a flexible belt, a disk, a rigid drum, a sheet around a rigid or compliant drum, or the like. The charge transport composition can be in the same layer as the charge generating compound and/or in a different layer from the charge generating compound. Additional layers can be used also, as described further below.

In some embodiments, the organophotoreceptor material comprises, for example: (a) a charge transport layer comprising the charge transport composition and a polymeric binder; (b) a charge generating layer comprising the charge generating compound and a polymeric binder; and (c) the electrically conductive substrate. The charge transport layer may be intermediate between the charge generating layer and the electrically conductive substrate. Alternatively, the charge generating layer may be intermediate between the charge transport layer and the electrically conductive substrate. In further embodiments, the organophotoreceptor material has a single layer with both a charge transport composition and a charge generating compound within a polymeric binder.

The organophotoreceptors can be incorporated into an electrophotographic imaging apparatus, such as laser printers. In these devices, an image is formed from physical embodiments and converted to a light image that is scanned onto the organophotoreceptor to form a surface latent image. The surface latent image can be used to attract toner onto the surface of the organophotoreceptor, in which the toner image is the same or the negative of the light image projected onto the organophotoreceptor. The toner can be a liquid toner or a dry toner. The toner is subsequently transferred, from the surface of the organophotoreceptor, to a receiving surface, such as a sheet of paper. After the transfer of the toner, the entire surface is discharged, and the material is ready to cycle again. The imaging apparatus can further comprise, for example, a plurality of support rollers for transporting a paper receiving medium and/or for movement of the photoreceptor, suitable optics to form the light image, a light source, such as a laser, a toner source and delivery system and an appropriate control system.

An electrophotographic imaging process generally can comprise (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) exposing the surface with a toner, such as a liquid toner that includes a dispersion of colorant particles in an organic liquid to create a toner image, to attract toner to the charged or discharged regions of the organophotoreceptor; and (d) transferring the toner image to a substrate.

The improved charge transfer compounds described herein comprise a linked group with a hydrazone group linking a divalent sulfonyldiphenylene group and either a divalent carbazole group or a divalent biscarbazole alkane group. For convenience, divalent carbazole groups and a divalent biscarbazole alkane groups are referred to collectively as carbazole-based groups. The linked group itself is divalent with a hydrazine functional group branching from the sulphonyldiphenylene group and an aldehyde or a ketone group branching from the carbazole-based group. Since the linked group is divalent, it can polymerize under appropriate conditions, described further below. Specifically, the compounds are based on a formula

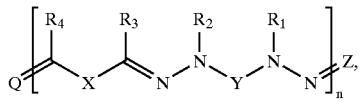

where the average n is between 1 and 1000, with n>1 corresponding to the polymer embodiments. $R_1$, $R_2$, $R_3$, and $R_4$ can be hydrogen or other substituents, as described below. X is a divalent carbazole group or a divalent biscarbazole alkane group, while Y is a divalent sulfonyldiphenylene group. Z and Q can be terminal groups (Z being two hydrogens or Q being a double bonded oxygen) or a hydrazone group bonded to an X group (for Z) and/or a Y group (for Q). Thus, since the basic monomer unit structure within square brackets [ ] above is difunctional, it can react through either functional group to extend the structure, under appropriate reactive conditions, or through both functional groups to oligomerize, more generally to polymerize, the monomer unit. Generally, the monomer can react with other monomers, with a divalent carbazole-based group and/or with a divalent sulfonyldiphenylene group. Thus, the value of n as well as the identity of Q and Z can be affected by the further reaction of the monomer. In general, if the reaction proceeds beyond the monomer, the charge transfer composition is comprised of a distribution of compounds.

In describing chemicals by structural formulae and group definitions, certain terms are used in a nomenclature format that is chemically acceptable. The terms groups and moiety have particular meanings. The term group indicates that the generically recited chemical entity (e.g., alkyl group, phenyl group, julolidine group, (N,N-disubstituted) arylamine group, etc.) may have any substituent thereon which is consistent with the bond structure of that group. For example, alkyl group includes alkyl materials such as methyl ethyl, propyl iso-octyl, dodecyl and the like, and also includes such substituted alkyls such as chloromethyl, dibromoethyl, 1,3-dicyanopropyl, 1,3,5-trihydroxyhexyl, 1,3,5-trifluorocyclohexyl, 1-methoxy-dodecyl, phenylpropyl and the like. However, as is consistent with such nomenclature, no substitution would be included within the term that would alter the fundamental bond structure of the underlying group. For example, where a phenyl group is recited, substitution such as 1-hydroxyphenyl, 2,4-fluorophenyl, orthocyanophenyl, 1,3,5-trimethoxyphenyl and the like would be acceptable within the terminology, while substitution of 1,1,2,2,3,3-hexamethylphenyl would not be acceptable as that substitution would require the ring bond structure of the phenyl group to be altered to a non-aromatic form because of the substitution. Where the term moiety is used, such as alkyl moiety or phenyl moiety, that terminology indicates that the chemical material is not substituted.

Organophotoreceptors

The organophotoreceptor may be, for example, in the form of a plate, a flexible belt, a disk, a rigid drum, or a sheet around a rigid or compliant drum, with flexible belts and rigid drums generally being used in commercial embodiments. The organophotoreceptor may comprise, for example, an electrically conductive substrate and a photoconductive element in the form of one or more layers. The organophotoreceptor comprises both a charge transport composition and a charge generating compound in a polymeric binder, which may or may not be in the same layer. For example, in some embodiments with a single layer construction, the charge transport composition and the charge generating compound are in a single layer. In other embodiments, however, the photoconductive element comprises a bilayer construction featuring a charge generating layer and a separate charge transport layer. The charge generating layer may be located intermediate between the electrically conductive substrate and the charge transport layer. Alternatively, the photoconductive element may have a structure in which the charge transport layer is intermediate between the electrically conductive substrate and the charge generating layer. In the dual layer embodiments, the charge generation layer generally has a thickness form about 0.5 to about 2 microns, and the charge transport layer has a thickness from about 5 to about 35 microns. In a single layer embodiment, the layer with the charge generating compound and the charge transport composition generally has a thickness from about 7 to about 30 microns.

The electrically conductive substrate may be flexible, for example in the form of a flexible web or a belt, or inflexible, for example in the form of a drum. A drum can have a hollow cylindrical structure that provides for attachment of the drum to a drive that rotates the drum during the imaging process. Typically, a flexible electrically conductive substrate comprises an electrically insulating substrate and a thin layer of electrically conductive material onto which the photoconductive material is applied.

The electrically insulating substrate may be paper or a film forming polymer such as polyethylene terepthalate, polyimide, polysulfone, polyethylene naphthalate, polypropylene, nylon, polyester, polycarbonate, polyvinyl fluoride, polystyrene and the like. Specific examples of polymers for supporting substrates included, for example, polyethersulfone (Stabar™ S-100, available from ICI), polyvinyl fluoride (Tedlar®, available from E.I. DuPont de Nemours & Company), polybisphenol-A polycarbonate (Makrofol™, available from Mobay Chemical Company) and amorphous polyethylene terephthalate (Melinar™, available from ICI Americas, Inc.). The electrically conductive materials may be graphite, dispersed carbon black, iodide, conductive polymers such as polypyroles and Calgon conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. In embodiments of particular interest, the electrically conductive material is aluminum. Generally, the photoconductor substrate will have a thickness adequate to provide the required mechanical stability. For example, flexible web substrates generally have a thickness from about 0.01 to about 1 mm, while drum substrates generally have a thickness of from about 0.5 mm to about 2 mm.

The charge generating compound is a material which is capable of absorbing light to generate charge carriers, such as a dye or pigment. Examples of suitable charge generating compounds include metal-free phthalocyanines, metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the tradename Indofast® Double Scarlet, Indofast® Violet Lake B, Indofast® Brilliant Scarlet and Indofast® Orange, quinacridones available from DuPont under the tradename Monastra™ Red, Monastral™ Violet and Monastral™ Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulphoselenide, cadmiumselenide, cadmium sulphide, and mixtures thereof. For some embodiments, the charge generating compound comprises oxytitanium phthalocyanine, hydroxygallium phthalocyanine or a combination thereof.

Generally, a charge generation layer comprises a binder in an amount from about 10 to about 90 weight percent and more preferably in an amount of from about 20 to about 75 weight percent, based on the weight of the charge generation layer. A charge transport layer generally comprises a binder in an amount from about 30 weight percent to about 70 weight percent. A single layer with a charge transport composition and a charge generating compound generally comprises a binder in an amount from about 10 weight percent to about 60 weight percent. A person of ordinary skill in the art will recognize that additional ranges of binder concentrations are contemplated and are within the present disclosure.

The binder generally is capable of dispersing or dissolving the charge transport composition (in the case of the charge transport layer or a single layer construction) and/or the charge generating compound (in the case of the charge generating layer or a single layer construction). Examples of suitable binders for both the charge generating layer and charge transport layer generally include, for example, polystyrene-co-butadiene, polystyrene-co-acrylonitrile, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly (hydroxyether) resins, polyhydroxystyrene resins, novolak, poly(phenylglycidyl ether)-co-dicyclopentadiene, copolymers of monomers used in the above-mentioned polymers, and combinations thereof. Preferably, the binder is selected from the group consisting of polycarbonates, polyvinyl butyral, and a combination thereof. Examples of suitable polycarbonate binders include polycarbonate A which is derived from bisphenol-A, polycarbonate Z, which is derived from cyclohexylidene bisphenol, polycarbonate C, which is derived from methylbisphenol A, and polyestercarbonates. Examples of suitable of polyvinyl butyral are BX-1 and BX-5 form Sekisui Chemical Co. Ltd., Japan.

The photoreceptor may optionally have additional layers as well. Such additional layers can be, for example, a sub-layer and overcoat layers such as barrier layers, release layers, and adhesive layers. The release layer forms the uppermost layer of the photoconductor element. The barrier layer may be sandwiched between the release layer and the photoconductive element or used to overcoat the photoconductive element. The barrier layer provides protection from abrasion to the underlayers. The adhesive layer locates and improves the adhesion between the photoconductive element, the barrier layer and the release layer, or any combination thereof. The sub-layer is a charge blocking layer and locates between the electrically conductive substrate and the photoconductive element. The sub-layer may also improve the adhesion between the electrically conductive substrate and the photoconductive element.

Suitable barrier layers include, for example, coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above barrier layer polymers optionally may contain small inorganic particles such as fumed silica, silica, titania, alumina, zirconia, or a combination thereof. Barrier layers are described further in U.S. Pat. No. 6,001,522 to Woo et al., entitled Barrier Layer For Photoconductor Elements Comprising An Organic Polymer And Silica," incorporated herein by reference. The release layer topcoat may comprise any release layer composition known in the art. In some embodiments, the release layer is a fluorinated polymer, siloxane polymer, fluorosilicone polymer, silane, polyethylene, polypropylene, polyacrylate, or a combination thereof. The release layers can comprise crosslinked polymers.

Generally, adhesive layers comprise a film forming polymer, such as polyester, polyvinylbutyral, polyvinylpyrolidone, polyurethane, polymethyl methacrylate, poly(hydroxy amino ether) and the like.

Sub-layers can comprise, for example, polyvinylbutyral, organosilanes, hydrolyzable silanes, epoxy resins, polyesters, polyamides, polyurethanes, silicones and the like. In some embodiments, the sub-layer has a dry thickness between about 20 Angstroms and about 2,000 Angstroms. Sublayers containing metal oxide conductive particles can be 1–25 microns thick.

The charge transport compositions as described herein, and photoreceptors including these compounds, are suitable for use in an imaging process with either dry or liquid toner development. Liquid toner development can be desirable because it offers the advantages of providing higher resolution images and requiring lower energy for image fixing compared to dry toners. Examples of suitable liquid toners are known in the art. Liquid toners generally comprise toner particles dispersed in a carrier liquid. The toner particles can comprise a colorant/pigment, a resin binder, and/or a charge director. In some embodiments of liquid toner, a resin to pigment ratio can be from 2:1 to 10:1, and in other embodiments, from 4:1 to 8:1. Liquid toners are described further in Published U.S. patent applications Ser. No. 2002/0128349, entitled "Liquid Inks Comprising A Stable Organosol," Ser. No. 2002/0086916, entitled "Liquid Inks Comprising Treated Colorant Particles," and Ser. No. 2002/0197552, entitled "Phase Change Developer For Liquid Electrophotography," all three of which are incorporated herein by reference.

Charge Transport Compositions

In some embodiments, the organophotoreceptors as described herein can comprise a charge transport composition having hydrazone-based compounds. Specifically, the charge transport composition comprises molecules having the formula (1)

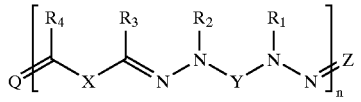

where the average n is between 1 and 1000;

$R_1$, $R_2$, $R_3$, and $R_4$ are, independently, hydrogen, a branched or linear alkyl group (e.g., a $C_1$–$C_{30}$ alkyl group), a branched or linear unsaturated hydrocarbon group, an ether group, a cycloalkyl group (e.g. a cyclohexyl group), or an aryl group (e.g., a phenyl or naphthyl group);

X is a divalent carbazole group;

Y is a divalent sulfonyldiphenylene group;

Z is $C(R_4)$—X—$C(R_3)$═O double-bonded to the adjacent N or two hydrogens where each hydrogen is independently single-bonded to the adjacent N; and Q is O or N—$N(R_1)$—Y—$N(R_2)$—$NH_2$.

The divalent carbazole group has a chemical structure as shown in Formula (2) where $R_8$ is hydrogen, a branched or linear alkyl group (e.g., a $C_1$–$C_{30}$ alkyl group), a branched or linear unsaturated hydrocarbon group, or an aryl group (e.g., a phenyl or naphthyl group); and $R_9$, $R_{10}$, $R_{11}$, $R_{12}$, $R_{13}$, and $R_{14}$ are, independently, hydrogen, a halogen atom, hydroxy group, thiol group, an alkoxy group, a branched or linear alkyl group (e.g., a $C_1$–$C_{20}$ alkyl group), a branched or linear unsaturated hydrocarbon group, an ether group, nitrile group, nitro group, an amino group, a cycloalkyl group (e.g. a cyclohexyl group), an aryl group (e.g., a phenyl or naphthyl group), or a part of cyclic or polycyclic ring.

(2)

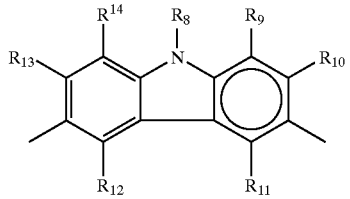

The divalent biscarbazole alkane group of this invention has a chemical structure as shown in Formula (3) where m is between 2 and 30; and $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ are, independently, hydrogen, a halogen atom, hydroxy group, thiol group, an alkoxy group, a branched or linear alkyl group (e.g., a $C_1$–$C_{20}$ alkyl group), a branched or linear unsaturated hydrocarbon group, an ether group, nitrile group, nitro group, an amino group, a cycloalkyl group (e.g. a cyclohexyl group), an aryl group (e.g., a phenyl or naphthyl group), or a part of cyclic or polycyclic ring.

(3)

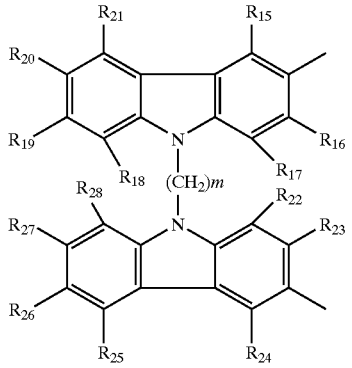

The divalent sulfonyldiphenylene group of this invention has one of the following chemical structures as shown in Formulas (4)–(6) where $R_{29}$, $R_{30}$, $R_{31}$, $R_{32}$, $R_{33}$, $R_{34}$, $R_{35}$, and $R_{36}$ are, independently, hydrogen, a halogen atom, hydroxy group, thiol group, an alkoxy group, a branched or linear alkyl group (e.g., a $C_1$–$C_{20}$ alkyl group), a branched or linear unsaturated hydrocarbon group, an ether group, nitrile group, nitro group, an amino group, a cycloalkyl group (e.g. a cyclohexyl group), an aryl group (e.g., a phenyl or naphthyl group) or a part of cyclic or polycyclic ring.

(4)

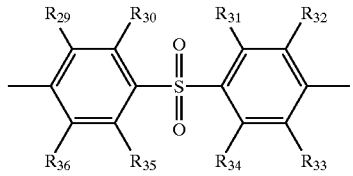

(5)

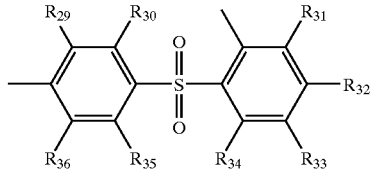

(6)

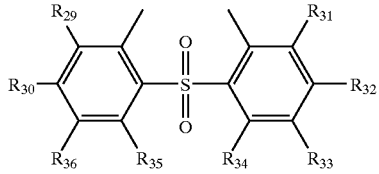

The N═Z bond in Formula (1) can be either a double bond or two single bonds. When it is a double bond, Z is $C(R_4)$—X—$C(R_3)$═O. When it comprises two single bonds, Z is two hydrogen atoms, each independently single-bonds to the adjacent nitrogen. The charge transport composition may or may not be symmetrical. In addition, the above-described formula for the charge transport composition is intended to cover isomers such as Formulas (4) to (6) above.

Non-limiting examples of the charge transport composition of this invention have the following formulas where the average n is between 1 and 1000 and $R_6$ and $R_7$ are, independently, hydrogen, a branched or linear alkyl group (e.g., a $C_1$–$C_{30}$ alkyl group), a branched or linear unsaturated hydrocarbon group, an ether group, a cycloalkyl group (e.g. a cyclohexyl group), or an aryl group (e.g., a phenyl or naphthyl group):

(7)
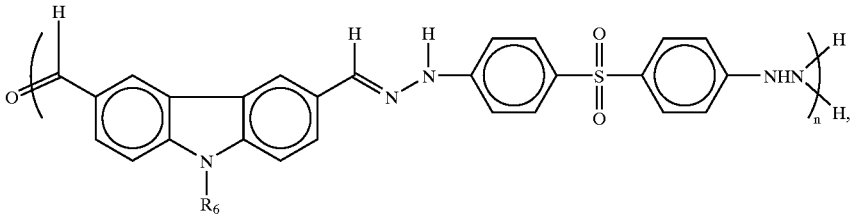
(8)
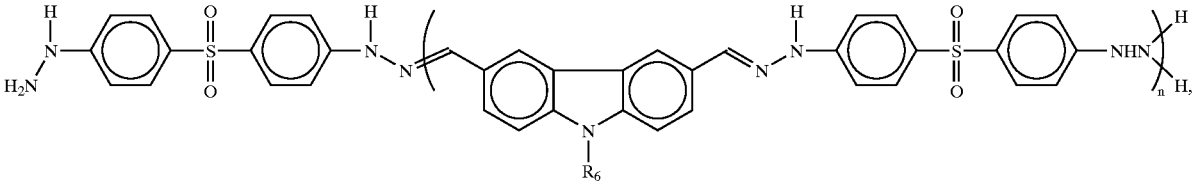
(9)
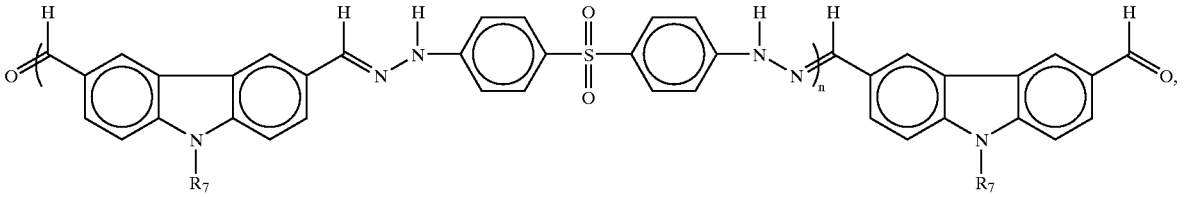
(10)
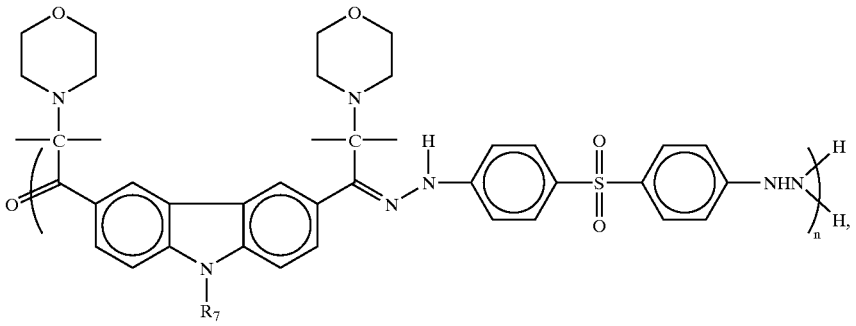
(11)
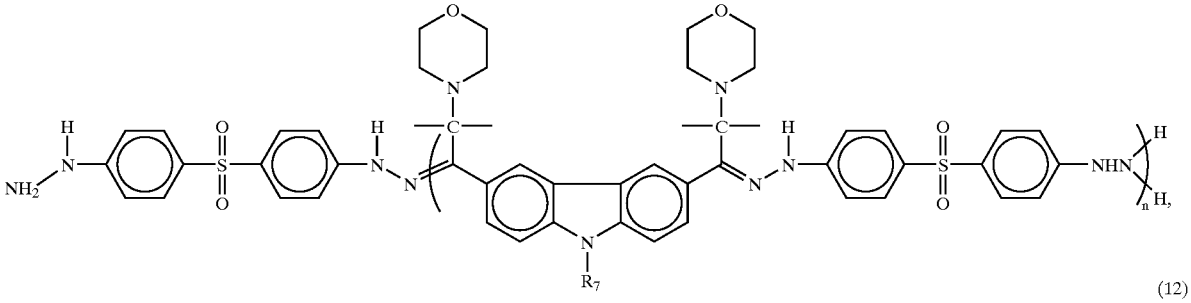
(12)
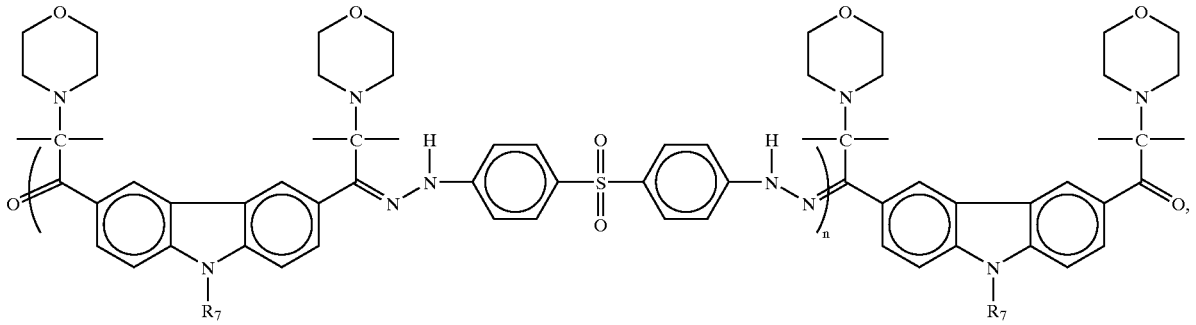

-continued
(13)
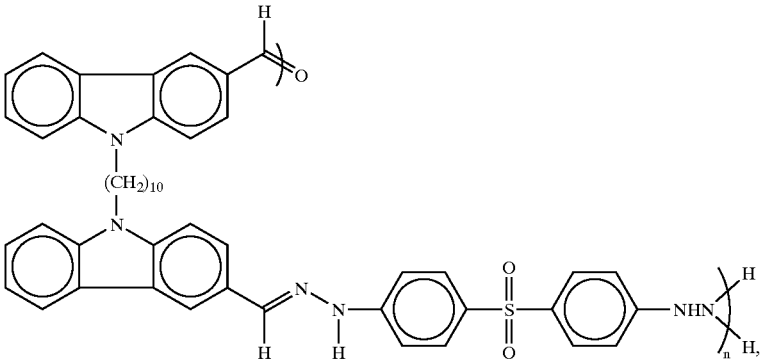
(14)
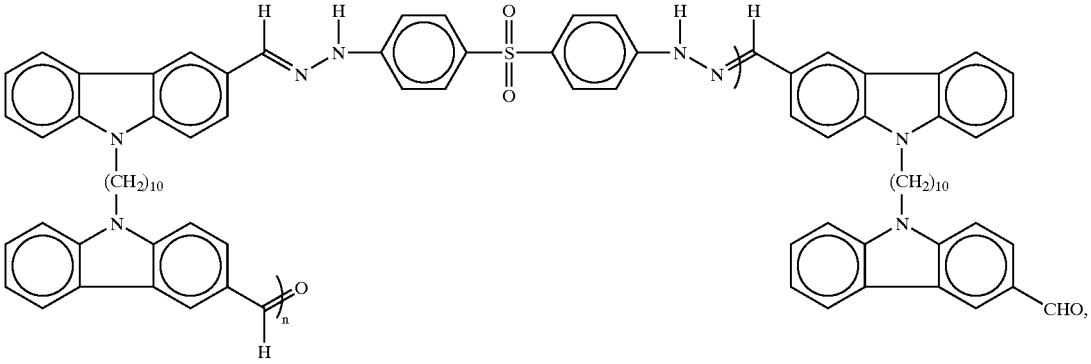
(15)
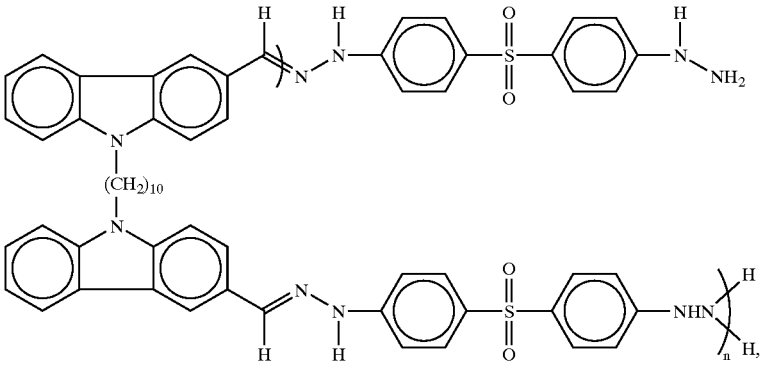
(16)
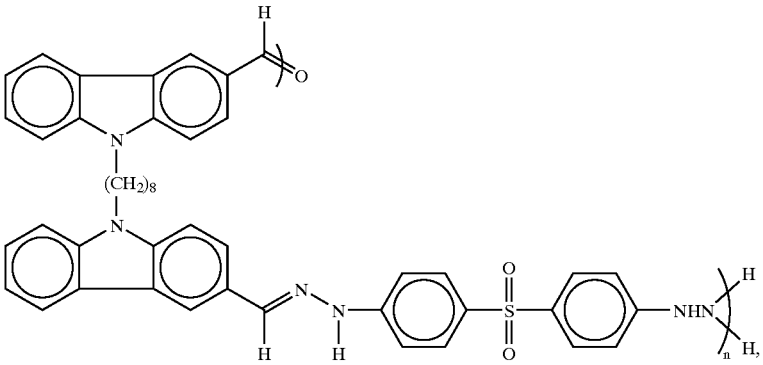

-continued (17)

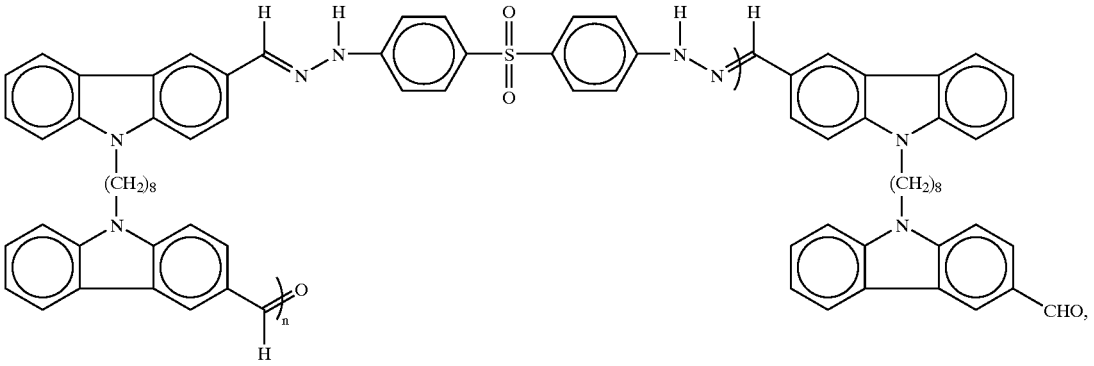

(18)

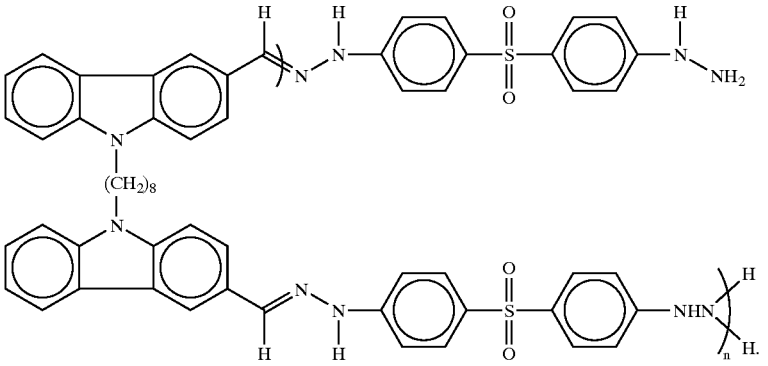

Synthesis Of Charge Transport Compositions

The charge transport compositions are based on the reaction products of a bishydrazine derivatized sulfonyldiphenylene group and a di-oxo/formyl derivatized carbazole based group. Specifically, the charge transport compositions described herein can be synthesized by first separately synthesizing or otherwise obtaining an appropriate bishydrazine sulfonyldiphenylene compound and carbazole-based group derivatized with two aldehyde or ketone functional groups. The charge transport compositions can then be synthesized in an appropriate acid catalyzed reaction of a mixture of a bishydrazine sulfonyldiphenylene compound and a carbazole-based group derivatized with two aldehyde or ketone functional groups. Whether or not a polymer is formed depends on the reaction conditions. Similarly, the character of the Z and Q elements in the above equation similarly depends on the reaction conditions.

To synthesize the charge transport compositions, the degree of polymerization, i.e., the average value and/or distribution of n, is determined by the concentrations of the reactants, the reaction conditions and the reaction time. These reaction parameters can be adjusted by a person of ordinary skill in the art, based on the present disclosure, to obtain desired values of the extent of reaction. In general, if a one-to-one ratio is used of the carbazole-based group and the bishydrazine, Q tends to be a double bonded oxygen, i.e., O, and Z tends to be two singly bonded hydrogens. A slight excess of carbazole-based compound tends to result in a greater percentage of the Z groups being a $C(R_4)$—X—$C(R_3)$=O group. Similarly, a slight excess of the bishydrazine reactant tends to result in a greater percentage of the Q being a sulfonyldiphenylene bishydrazine group.

More specifically, the carbazole-based compound and bishydrazine react to form a bifunctional monomer unit. Under sufficiently dilute reaction conditions and a sufficiently short reaction time, the monomer composition effectively can be formed. To the extent that the reaction proceeds further, a bifunctional monomer unit can further react with other monomer units, the carbazole-based compound and/or bishydrazine to form another difunctional compound that can further react. This reaction process continues until the reaction is stopped. The resulting product generally can be characterized by an average molecular weight and a distribution of molecular weights as well as a distribution of identities of substituents Q and Z. Various techniques used for characterizing polymers generally can be used to correspondingly characterize the polymers described herein.

1,1'-(sulfonyldi-4,1-phenylene)bishydrazine is commercially available from Vitas-M, Moscow, Russia (Phone 7 095 939 5737). Derivatized versions of this compound can be synthesized by a person of ordinary skill in the art, for example, using conventional techniques. The carbazole-based compounds, in general, can be synthesized using commercially available carbazole as a starting material. The carbazole can be used to synthesize the appropriate derivatized carbazole and the derivatized biscarbazolyl alkanes. The synthesis of several derivatized carbazoles and derivatized biscarbazolyl alkanes are described in the Examples below. Also, 3,6,bis(2-methyl-2-morpholino propionyl)-9-octylcarbazole is available commercially from Aldrich Chemical, Milwaukee, Wis.

Organophotoreceptor (OPR) Preparation Methods

Following conventional terminology, the number of layers in the OPR refers to the layers with charge transport compositions and/or charge generating compounds. Thus, the presence of overlayers, underlayers, release layers and the like do not alter the single layer versus dual layer terminology.

Positive Inverted Dual Layer OPR

A positive polarity, inverted dual layer organic photoreceptor can be prepared by incorporating a charge transfer compound disclosed herein into the charge transport layer and then over coating this layer with a charge generation solution to form a charge generation layer. The positive inverted dual layer is designed to operate with a positive surface charge that is discharge upon illumination at the point of illumination. An example of a specific approach for forming this structure is presented below.

In one embodiment, a charge transport solution comprising a 1:1 ratio by weight of a charge transfer compound as described herein to a binder, such as polycarbonate Z binder (commercially available from Mitsubishi Gas Chemical under the trade name Lupilon ™Z-200 resin), can be prepared by combining a solution of 1.25 g of one of the charge transfer compounds as described herein in 8.0 g of tetrahydrofuran with 1.25 g of polycarbonate Z in 6.25 g of tetrahydrofuran. The charge transport solution can be hand-coated onto a 76-micrometer (3-mil) thick aluminized polyester substrate (such as a Melinex® 442 polyester film from Dupont having a 1 ohm/square aluminum vapor coat) having a 0.3-micron polyester resin sub-layer (Vitel® PE-2200 from Bostik Findley, Middletown, Mass.). A knife coater, set to a 51-micrometer (2-mil) orifice between the blade and polyester, can be used to prepare a film with an 8–10-micron thickness after drying the wet film in an oven at 110° C. for 5–10-min.

A dispersion for forming a charge generation layer can be prepared by micronising 76.1 g of oxytitanium phthalocyanine pigment (H.W. Sands Corp., Jupiter, Fla.), 32.6 g of S-Lec B Bx-5 polyvinylbutryal resin (Sekisui Chemical Co. Ltd.), and 641.3 g of methyl ethyl ketone, using a horizontal sand mill operating in recycle mode for 8 hours. After milling, the charge generation layer base can be diluted with methyl ethyl ketone to decrease the total solids of the solution to 4.0 wt %. The charge generation solution can be hand-coated onto the charge transport layer using a knife coater, set to a 20–25 micron (0.8–1.0 mil) orifice between the blade and charge transfer layer to prepare a sub-micron thick charge generation layer (CGL) film after drying the wet film in an oven at 110° C. for 3–5 min.

Negative Dual Layer OPR

A negative polarity, dual layer organic photoreceptor can be prepared forming a charge generation layer and then incorporating a charge transfer compound disclosed herein into a solution and coating this solution over the charge generation layer to form a charge transfer layer. A negative dual layer is designed to operate with a negative surface charge that is discharged upon illumination at the point of illumination. A specific example for forming a negative dual layer is described below.

In one embodiment, a charge generation layer mill-base dispersion can be prepared by micronising 76.1 g of oxytitanium phthalocyanine pigment, 32.6 g of S-Lec B Bx-5 polyvinylbutryal resin (Sekisui Chemical Co. Ltd.), and 641.3 g of methyl ethyl ketone, using a horizontal sand mill operating in recycle mode for 8 hours. Following milling the charge generating layer base can be diluted with methyl ethyl ketone to decrease the total solids of the solution to 4.0 wt %. The charge generation solution can be hand-coated onto a 76-micrometer (3-mil) thick aluminized polyester substrate (Melinex® 442 polyester film from Dupont having a 1 ohm/square aluminum vapor coat) having a 0.3-micron polyester resin sub-layer (Vitel® PE-2200 from Bostik Findley, Middletown, Mass.). A knife coater, set to a 20–25 micron (0.8–1.0 mil) orifice between the blade and substrate, can be used to prepare the sub-micron thick charge generating layer film after drying the wet film in an oven at 110° C. for 3–5 min.

A charge transport solution comprising a 1:1 ratio by weight of a charge transfer compound described herein to polycarbonate Z binder is prepared by combining a solution of 1.25 g of the charge transfer compound in 8.0 g of tetrahydrofuran with 1.25 g of polycarbonate Z in 6.25 g of tetrahydrofuran. A knife coater, set to a 51-micrometer (2-mil) orifice between the blade and polyester, can be used to prepare an 8–10-micron thick film after drying the wet film in an oven at 110° C. for 5–10 min.

Single Layer OPR

A single layer organic photoreceptor can be prepared by incorporating a charge transfer compound disclosed herein along with a charge generating composition into a single coating solution and then coating this solution over a suitable substrate. A single layer OPR are designed to operate with a surface charge, which may be positive or negative, that is discharged upon illumination at the point of illumination in which the charge is generated in a layer and transported through that layer.

In practice, single layer OPRs are used predominantly with positive surface charges. In general, through the photoconductive and semiconductive materials of interest, electrons have a significantly lower mobility that holes. With low concentrations of charge generating pigment compounds to limit charge trapping in a single layer structure, the electron-hole pairs can be generated some distance from the surface of the OPR after light is absorbed. However, the electron-hole pairs still tend to be closer to the surface than the substrate, such that the electron has less distance to travel than the hole in a positive single layer OPR. The hole from the electron-hole pair can transport through the remaining portion of the OPR to the underlying substrate. Thus, while electrons may travel some distance to neutralize positive charges at the surface of a positively charged OPR, the electrons would still have significantly larger distance to travel to the substrate in a negative single layer OPR. For single layer embodiments, it can be desirable to include an optional electron transport compound to facilitate the electron transport.

However, the use of a dual layer positive OPR is complicated by the formation of a thin charge generating layer over a charge transport layer due to processing complications of dip coating and solvent selection. Also, the thin charge generating layer can be abraded away in use without a good overcoat layer. Thus, a single layer positive OPR may offer some advantages over a positive dual layer system. Since the formation of negative dual layer OPRs do not have the complications of positive dual layer OPRs and since limited electron mobility hinders operation of negative single layer OPRs, negative single layer OPRs generally are less desirable although they are within the scope of the present disclosure for incorporation of the improved charge transport compositions described herein.

In one embodiment especially for the preparation of a single layer OPR, a charge transport pre-mix solution containing a 1:1 ratio by weight of a charge transport composition disclosed herein to polycarbonate Z binder can be prepared by combining a solution of 1.25 g of the charge transfer compound in 8.0 g of tetrahydrofuran with 1.25 g of polycarbonate Z in 6.25 g of tetrahydrofuran. A charge generating layer mill-base dispersion can be prepared by micronising 76.1 g of oxytitanium phthalocyanine pigment, 32.6 g of polycarbonate Z binder resin, and 641.3 g of tetrahydrofuran, using a horizontal sand mill operating in pass mode for 6–8 passes. An electron transport pre-mix solution containing a 1:1.4 ratio of (4-n-butoxycarbonyl-9-fluorenylidene) malonitrile electron transfer compound to Polycarbonate Z binder can be prepared by combining a solution of 1.25 g of one of the electron transporting material in 8.0 g of tetrahydrofuran with 1.75 g of polycarbonate Z in 9 g of tetrahydrofuran.

The single layer coating solution can be prepared by combining 14 g of the charge transport pre-mix, 4.08 g of the electron transport premix and 1.92 g of the charge generating layer mill-base dispersion. The single layer solution can be hand-coated onto a 76-micrometer (3-mil) thick aluminized polyester substrate (Melinex® 442 polyester film from Dupont having a 1 ohm/square aluminum vapor coat) having a 0.3-micron polyester resin sub-layer (Vitel® PE-2200 from Bostik Findley, Middletown, Mass.). A knife coater, set to a 50–75 micron (2–3 mil) orifice between the blade and substrate, can be used to prepare a single layer film with an 8–10 micron thickness after drying the wet film in an oven at 110° C. for 5–10 min.

The invention will now be described further by way of the following examples.

EXAMPLES

Example 1

Synthesis of Difunctional Carbazole-Based Compounds

This example describes the synthesis of both diformyl carbazole compounds and bis(3-formyl-9-carbazolyl)alkane compounds.

N-Heptyl-3,6-Diformylcarbazole

A 88.69 g quantity of carbazole (0.53 mol, commercially available from Aldrich, Milwaukee, Wis.), 100 g 1-bromoheptane (0.56 mol, commercially available from Aldrich, Milwaukee, Wis.), 6.00 g benzyltriethyl ammonium chloride (0.026 mol, commercially available from Aldrich, Milwaukee, Wis.) and 400 ml of toluene were added to a 1 liter 3-neck round bottom flask equipped with reflux condenser and mechanical stirrer. The mixture was stirred at room temperature for 0.5 hr., followed by the addition of an aqueous solution of NaOH (prepared by dissolving 100 g of NaOH in 100 g water). The mixture was refluxed for 5 hr. and then cooled to room temperature. The organic phase was separated and washed repeatedly with water until the pH of the washing water was neutral. The organic phase was dried over magnesium sulfate, filtered, and evaporated to dryness to obtain 126 g of brown liquid (89% yield) comprising N-heptyl carbazole.

A 271 ml quantity of DMF (3.5 mol) was added to a 1-liter, 3-neck round bottom flask equipped with mechanical stirrer, thermometer, and addition funnel. The contents were cooled in a salt/ice bath. When the temperature inside the flask reaches 0° C., 326 ml of $POCl_3$ (3.5 mol) was slowly added. During the addition of $POCl_3$, the temperature inside the flask was not allowed to rise above 5° C. After the addition of $POCl_3$ was completed, the reaction mixture was allowed to warm to room temperature. A 126 g quantity of N-heptylcarbazole was then added, and the flask was heated to 90° C. for 24 hr using a heating mantle. The reaction mixture was cooled to room temperature, and the solution was added slowly to a 4.5 liter beaker containing a solution of 820 g sodium acetate dissolved in 2 liters of water. The beaker was cooled in an ice bath and stirred for 3 hr. The brownish solid obtained was filtered and washed repeatedly with water, followed by a small amount of ethanol (50 ml). The resulting product was recrystallized once from toluene using activated charcoal and dried under vacuum in an oven heated at 70° C. for 6 hr to obtain 80 g (51% yield) of N-heptyl-3,6-diformyl-carbazole.

N-Dodecyl-3,6-Diformylcarbazole

N-Dodecyl carbazole was prepared from carbazole (66 g, 0.40 mol), 1-bromododecane (100 g, 0.41 mol, commercially available from Aldrich, Milwaukee, Wis.), benzyltriethyl ammonium chloride (4.48 g, 0.02 mol), toluene (400 ml), and sodium hydroxide (200 g of 50% aqueous solution) according to the procedure described for N-heptylcarbazole N-Dodecyl-3, 6-diformyl carbazole was prepared from DMF (186 ml, 2.4 mol), $POCl_3$ (224 ml, 2.4 mol), and N-dodecylcarbazole (115 g, 0.34 mol), according to the procedure described for N-hepyl-3,6-Diformylcarbazole. The product was recrystallized once from THF/water to yield 100 g of a brown solid (75% yield).

N-Tridecyl-3,6-Diformylcarbazole

N-Tridecylcarbazole was prepared from carbazole (62.43 g, 0.37 mol), 1-bromotridecane (100 g, 0.38 mol, commercially available from Aldrich, Milwaukee, Wis.), benzyltriethyl ammonium chloride (4.24 g. 0.018 mol), toluene (400 ml), and 50% aqueous NaOH (200 g) according to the procedure described for N-heptylcarbazole. The product was obtained as 120 g of brown liquid (96% yield).

N-Tridecyl-3,6-diformyl carbazole was prepared from DMF (186 ml, 2.4 mol), $POCl_3$ (224 ml, 2.4 mol), and N-tridecylcarbazole (120 g, 0.34 mol) according to the procedure described for N-heptyl-3,6-Diformylcarbazole. The product was recrystallized from THF/water to yield 130 g (84% yield) of purified product.

N-Tetradecyl-3,6-Diformylcarbazole

N-Tetradecylcarbazole was prepared from carbazole (59.27 g, 0.35 mol), 1-bromotetradecane (100 g, 0.36 mol, commercially available from Aldrich, Milwaukee, Wis.), benzyltriethyl ammonium chloride (4.00 g, 0.018 mol), 50% aqueous NaOH (200 g), and toluene (400 ml) according to the procedure described for N-heptylcarbazole. The product was obtained as 120 g of a brown liquid (93% yield). Upon standing at room temperature overnight, the liquid solidified.

N-Tetradecyl-3,6-diformylcarbazole was prepared from DMF (186 ml, 2.4 mol), $POCl_3$ (224 ml, 2.4 mol), and N-tetradecylcarbazole (120 g, 0.33 mol) according to the procedure described for N-heptyl-3,6-Diformylcarbazole. 117 g of product were obtained (84% yield).

N-propylphenyl-3,6-Diformylcarbazole

N-Propylphenylcarbazole was prepared from carbazole (82.18 g, 0.49 ml), 1-bromo-3-phenylpropane (100 g, 0.50 mol, commercially available from Aldrich, Milwaukee, Wis.), benzyltriethyl ammonium chloride (5.58 g, 0.025 mol), toluene (400 ml), and 50% aqueous NaOH (200 g) according to the procedure described for N-heptylcarbazole. 108 g of the product was obtained as a white solid (77% yield).

N-Propylphenyl-3,6-diformyl carbazole was prepared from DMF (204 ml, 2.64 mol), $POCl_3$ (246 ml, 264 mol), and N-propylphenylcarbazole (107.84 g, 0.38 mol) according to the procedure described for N-heptyl-3,6-Diformylcarbazole. A brownish solid was obtained which was recrystallized from THF/water to yield 91.5 g (70% yield) of the product.

N-2-Ethylhexyl-3,6-Diformylcarbazole

N-2-Ethylhexylcarbazole was prepared from carbazole (85.09 g, 0.51 mol), 2-ethylhexylbromide (100 g, 0.52 mol, commercially available from Aldrich, Milwaukee, Wis.), benzyltriethyl ammonium chloride (5.78 g, 0.025 mol), toluene (400 ml), and 50% aqueous NaOH solution (200 g) according to the procedure described for N-heptylcarbazole. The product was obtained as 115 g of brownish liquid (81% yield).

N-2-ethylhexyl-3,6-diformyl carbazole was prepared from DMF (97 ml, 1.25 mol), $POCl_3$ (116.5 ml, 1.25 mol), and N-2-ethylhexylcarbazole (50 g, 0.18 mol) according to the procedure described for N-heptyl-3,6-Diformylcarbazole. The product was obtained as 40 g of brownish liquid (66% yield). The product was used as is in the next step without any purification.

Other bromo-alkanes can be used in equivalent procedures to the procedure above to form N-substitutes 3,6-diformyl carbazoles with different nitrogen substitutions. For example, 1-bromopentane and 1-bromodecane are also commercially available from Aldrich Chemical, Milwaukee, Wis.

1,10-Bis(3-formyl-9-carbazolyl)decane

Carbazole (120 g, 0.72 mol, commercially obtained from Aldrich, Milwaukee, Wis.), dibromodecane (100 g, 0.33 mol, commercially obtained from Aldrich, Milwaukee, Wis.), and benzyltriethyl ammonium chloride (12 g) were dissolved in tetrahydrofuran (400 mL), and a concentrated solution of sodium hydroxide (120 g) in water (120 mL) was added to the tetrahydrofuran solution. The mixture was heated at reflux with strong mechanical stirring for 4 hours. Then, the mixture was cooled to room temperature and poured into an excess of water. The solid that precipitated was filtered off, and the tetrahydrofuran layer was dried by magnesium sulfate and concentrated to dryness. The combined organic solids were recrystallized from tetrahydrofuran/water and dried in a vacuum oven to yield 116.5 g (69%, m.p.=130 ° C.) of 1,10-bis(9-carbazoyl) decane as an off-white solid.

To obtain the formyl derivatized compound, dimethylformamide (200 mL) was stirred and cooled in an ice bath while phosphorus oxychloride (70 mL, 115 g, 0.75 mol, commercially obtained from Aldrich, Milwaukee, Wis.) was gradually added to form an initial mixture. 1,10-bis(9-carbazoyl)decane (100 g, 0.22 mol) was introduced to the initial mixture, and the resulting mixture can be heated on a steam bath with stirring for 1.5 hours. A viscous, dark brown liquid was generated from which a yellow solid precipitates upon cooling. This entire mixture was added to water (400 mL), and the crude product was filtered off at the pump, washed with water (200 mL), and then with a little ethanol. Recrystallization from tetrahydrofuran/water afforded 1,10-bis(3-formyl-9-carbazolyl)decane as light brown crystals (92.3 g, 83%). The crystals had a melting point of 122° C.

1,8-Bis(3-formylcarbazolyl)octane 1,8-Bis(3-formylcarbazolyl)octane (m.p.=162° C.) was synthesized via an analogous procedure to that employed in the preparation of 1,10-bis(3-formyl-9-carbazolyl)decane. The formylation was achieved in a 76% yield.

Other dibromoalkanes, such as dibromooctane, can be substituted within the above procedure to obtain corresponding 1,10-bis(3-formyl-9-carbazolyl)alkanes.

Example 2

Synthesis of Charge Transport Compositions

Charge transport compositions were synthesized as follows. The number associated with each compound refers to the number of the chemical formula set forth above.

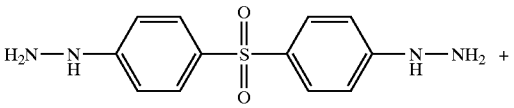

-continued

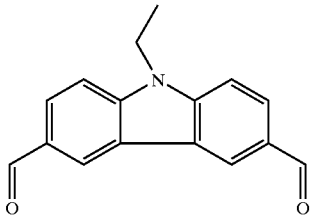

Synthesis of Compound (8)

A 150 ml quantity of tetrahydrofuran (THF) and 9-ethyl-3,6-diformylcarbazole (1.5 g, 5.97 mmol, prepared previously) and (1,1'-(sulfonyldi-4,1-phenilene)bis) hydrazine (1.1 g , 3.98 mmol , commercially available from Vitas-M, Moscow, Russia (Phone 7 095 939 5737) were added to a 250 ml round bottom flask equipped with a reflux condenser and mechanical stirrer to form a suspension. The suspension was heated to reflux for 4 hours, whereas the monomers dissolved completely and a slightly brown colored solution obtained. The reaction mixture was cooled down to the room temperature, and the insoluble part of the product was separated (~1.36 g). The reaction mixture was concentrated by distillation (to approximately 50 ml), and this solution was added to 400 ml hexane. The solid product was filtered off and recrystalyzed from THF/hexane and dried at 500° C. for a period of 5 hours. Following recrystallization, 1.18 g of yellow amorphous powder was obtained, which was soluble in THF and DMF.

The powder was characterized by infrared specroscopy which yielded peaks interpreted as follows: IR (KBr): 3300 (—NH), 2995 ($—CH_2—CH_3$), 1600, 1500 (—C═C—), 1385, 1150, 1105 ($—SO_2—$) $cm^{-1}$. The powder was also characterized by proton NMR which yielded peaks interpreted as follows: $^1$H-NMR (THF-$d_8$): δ= 1.2–1.5 (m, $—CH_3$), 4.32 (m, $═NCH_2—$), 7.12 (m, aromatic), 7.4–8 (m, aromatic and —CH—).

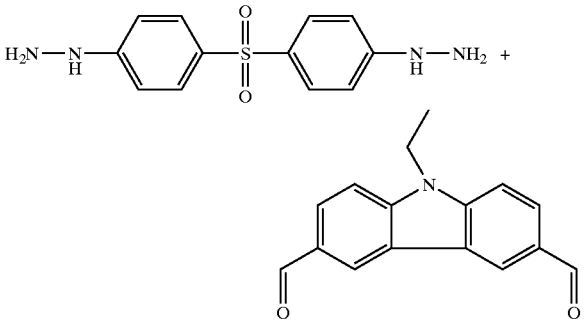

Synthesis of Compound (13)

A 25 ml quantity of THF and (1,1'-(sulfonyldi-4,1-phenilene)bis) hydrazine (0.556 g, 2 mmole, commercially available from Vitas-M, Moscow, Russia (Phone 7 095 939 5737) were added to a 50 ml round bottom flask equipped with reflux condenser and mechanical stirrer. The solution was stirred at room temperature for about five minutes. Then, a solution of 1,10-bis (3-formyl-9-carbazolyl) decane (1.056 g, 2 mmol, prepared previously) in 10 ml THF was slowly added to the flask. The resulting suspension was heated to reflux for 1 hour. After the reflux, the reaction mixture was cooled down to room temperature, and a yellow-brownish solid was filtered off. The solid was washed several times with tetrahydrofuran and dried at 50°

C. vacuum oven for 5 hours to yield 1.06 g of yellow-brownish amorphous powder.

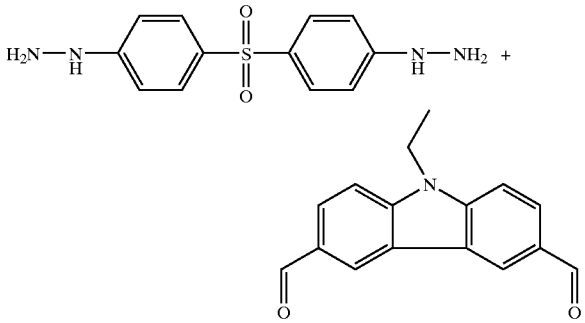

Synthesis of Compound (14)

A 15 ml quantity of THF and (1,1'-(sulfonyldi-4,1-phenilene)bis) hydrazine (0.139 g , 0.5 mmole, commercially available from Vitas-M, Moscow, Russia (Phone 7 095 939 5737) were added to a 25 ml round bottom flask equipped with reflux condenser and mechanical stirrer. The solution was stirred at room temperature for about five minutes. Then, a solution of 1,10-bis (3-formyl-9-carbazolyl) decane (0.528 g, 1 mmol, prepared previously) in 5 ml THF was slowly added to the flask. The suspension was heated to reflux for 1 hour. After the reflux, the reaction mixture was cooled down to the room temperature and was added to large excess of chloroform (70 ml). A red solid was filtered off, washed several times with chloroform and dried at 50° C. vacuum oven for 5 hours. A 0.18 g quantity of red amorphous powder was obtained.

Synthesis of Compound (15)

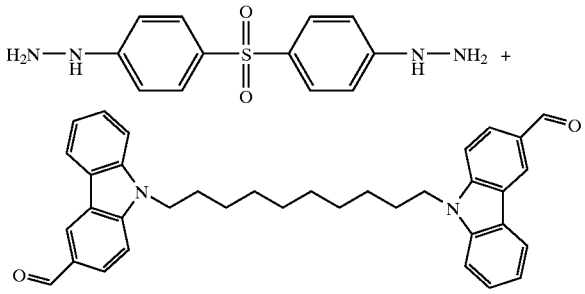

A 100 ml quantity of THF and (1,1'-(sulfonyldi-4,1-phenilene)bis) hydrazine (1.58 g, 5.7 mmol, commercially available from Vitas-M, Moscow, Russia (Phone 7 095 939 5737) were added to a 250 ml round bottom flask equipped with reflux condenser and mechanical stirrer. The solution was stirred at room temperature for about five minutes. Then, a solution of 1,10-bis(3-formyl-9-carbazolyl)decane (2 g, 3.8 mmol, prepared previously) in 180 ml THF was slowly added to the flask. The suspension was heated to reflux for 1 hour, and the monomers dissolved completely to form a slightly brown colored solution. The reaction mixture was cooled down to the room temperature, and the insoluble part of the product was separated. The reaction mixture was concentrated by distillation (to ~50 ml) and added to 500 ml of methanol. The oligomer solid was filtered off. The solid was recrystalyzed from a mixture of THF/methanol and dried at 500° C. vacuum oven for 5 hours to yield 1.28 g of yellow amorphous powder which was soluble in THF, DMF.

The solid was further characterized by infrared sprectroscopy, which yielded peaks interpreted as follows: IR (KBr): FT-IR (KBr): 3300 (—NH), 2930, 2860 ($—CH_2—$), 1600, 1500 (—C=C—), 1385, 1150, 1105 ($—SO_2—$) $cm^{-1}$. Proton NMR spectrum of the powder yielded peaks that were interpreted as follows: $^1$H-NMR (THF-$d_8$): δ=1.16 (m, $—CH_2—$), 1.69 (m, $—CH_2—$), 4.31 (m, $=NCH_2—$), 7.01–8.3 (m, aromatic and —CH—), 9.55 (s, —NH—), 10.8 (s, $—NH_2$).

Example 3

Ionization Potential

This example provides measurements of the ionization potential for three charge transport compounds synthesized as described in Example 2.

Samples for ionization potential (Ip) measurements were prepared by dissolving the compound in tetrahydrofuran. The solution was hand-coated on an aluminized polyester substrate that was precision coated with a methylcellulose-based adhesion sub-layer to form a charge transport material (CTM) layer. The role of this sub-layer was to improve adhesion of the CTM layer, to retard crystallization of CTM, and to eliminate the electron photoemission from the A1 layer through possible CTM layer defects. No photoemission was detected from the A1 through the sub-layer at illumination with up to 6.4 eV quanta energy light. In addition, the adhesion sub-layer was conductive enough to avoid charge accumulation on it during measurement. The thickness of both the sub-layer and CTM layer was ~0.4 μm. No binder material was used with CTM in the preparation of the samples for Ip measurements.

The ionization potential was measured by the electron photoemission in air method similar to that described in "Ionization Potential of Organic Pigment Film by Atmospheric Photoelectron Emission Analysis", *Electrophotography*, 28, Nr. 4, p. 364. (1989) by E. Miyamoto, Y. Yamaguchi, and M. Yokoyama, which is hereby incorporated by reference. The samples were illuminated with monochromatic light from a quartz monochromator with a deuterium lamp source. The power of the incident light beam was $2–5\cdot10^{-8}$ W. The negative voltage of −300 V was supplied to the sample substrate. The counter-electrode with the 4.5×15 $mm^2$ slit for illumination was placed at 8 mm distance from the sample surface. The counter-electrode was connected to the input of the BK2-16 type electrometer, working in the open impute regime, for the photocurrent measurement. A $10^{-15-10-12}$ amp photocurrent was flowing in the circuit under illumination. The photocurrent, I, was strongly dependent on the incident light photon energy hv. The $I^{0.5}$=f(hv) dependence was plotted. Usually the dependence of the square root of photocurrent on incident light quanta energy is well described by linear relationship near the threshold (see references "Ionization Potential of Organic Pigment Film by Atmospheric Photoelectron Emission Analysis", *Electrophotography*, 28, Nr. 4, p. 364. (1989) by E. Miyamoto, Y. Yamaguchi, and M. Yokoyama; and "Photoemission in Solids", Topics in Applied Physics, 26, 1–103. (1978) by M. Cordona and L. Ley, incorporated herein by reference). The linear part of this dependence was extrapolated to the hv axis and Ip value was determined as the photon energy at the interception point. The ionization potential measurement has an error of ±0.03 eV.

The ionization potential data for compounds 8, 14 and 15 are listed in Table 1.

TABLE 1

| Compound | $\mu_0$ ($cm^2$/V · s) | $\mu$ ($cm^2$/V · s) at $6.4 \cdot 10^5$ V/cm | $\alpha$ $(cm/V)^{0.5}$ | Ionization Potential (eV) |
|---|---|---|---|---|
| Compound 8 | $7 \cdot 10^{-11}$ | $7 \cdot 10^{-8}$ | 0.0087 | 5.47 |
| Compound 15 | $1 \cdot 10^{-12}$ | $1 \cdot 10^{-8}$ | 0.01 | 5.50 |
| Compound 14 | $2 \cdot 10^{-10}$ | $1.5 \cdot 10^{-8}$ | 0.005 | 5.43 |

Example 4

Hole Mobility

This example presents hole mobility measurements for some of the charge transport compounds synthesized as described in Example 2.

The hole drift mobility was measured by a time of flight technique as described in "The discharge kinetics of negatively charged Se electrophotographic layers," Lithuanian Journal of Physics, 6, p. 569–576 (1966) by E. Montrimas, V. Gaidelis, and A. Pažera, which is hereby incorporated by reference. Positive corona charging created electric field inside the CTM layer. The charge carriers were generated at the layer surface by illumination with pulses of nitrogen laser (pulse duration was 2 ns, wavelength 337 nm). The layer surface potential decreased as a result of pulse illumination by up to 1–5% of initial pre-illumination potential. The capacitance probe that was connected to the wide frequency band electrometer measured the speed of the surface potential dU/dt. The transit time $t_t$ was determined by the change (kink) in the curve of the dU/dt transient in linear or double logarithmic scale. The drift mobility was calculated by the formula $\mu = d^2/U_0 \cdot t_t$, where d is the layer thickness and $U_0$ is the surface potential at the moment of illumination.

To prepare the sample for the measurements, a mixture of 0.1 g of the charge transport compound and 0.1 g of polycarbonate Z 200 (S-LEC B BX-1, commercially obtained from Sekisui) was dissolved in 2 ml of THF. The solution was coated on the polyester film with conductive A1 layer by the dip roller method. After drying for 1 h at 80° C., a clear 10 $\mu$m thick layer was formed. Samples were prepared for compounds 8, 14, and 15. The hole mobility of the sample was measured, and the results are presented in Table 1. Mobility values at electric field strength, E, of $6.4 \cdot 10^5$ V/cm are given in the Table 1 along with zero field mobilities $\mu_0$. The mobility field dependencies may be approximated by the function $$\mu \sim e^{\alpha \sqrt{E}}$$

where $\alpha$ is parameter characterizing mobility field dependence. The value of the parameter $\alpha$ is also given in Table 1.

The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. An organophotoreceptor comprising:

(a) a charge transport composition comprising molecules having the formula

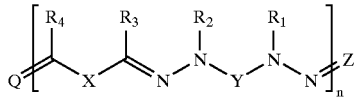

where the average n is between 1 and 1000;

$R_1$, $R_2$, $R_3$, and $R_4$ are, independently, hydrogen, a branched or linear alkyl group, a branched or linear unsaturated hydrocarbon group, an ether group, a cycloalkyl group, or an aryl group;

X is a divalent carbazole group or a divalent biscarbazole alkane group;

Y is a divalent sulfonyldiphenylene group;

Z is $C(R_4)$—X—$C(R_3)$═O double-bonded to the adjacent N or two hydrogens where each hydrogen is independently single-bonded to the adjacent N; and Q is O or N—$N(R_1)$—Y—$N(R_2)$—$NH_2$;

(b) a charge generating compound; and (c) an electrically conductive substrate over which the charge transport composition and the charge generating compound are located.

2. An organophotoreceptor according to claim 1 wherein said organophotoreceptor is in the form of a flexible belt.

3. An organophotoreceptor according to claim 1 wherein said organophotoreceptor is in the form of a drum.

4. An organophotoreceptor according to claim 1 comprising:

(a) a charge transport layer comprising said charge transport composition and a polymeric binder; and (b) a charge generating layer comprising said charge generating compound and a polymeric binder.

5. An organophotoreceptor according to claim 1 wherein X is a divalent carbazole group.

6. An organophotoreceptor according to claim 1 wherein said charge transport composition comprises a compound with a formula selected from the group consisting of

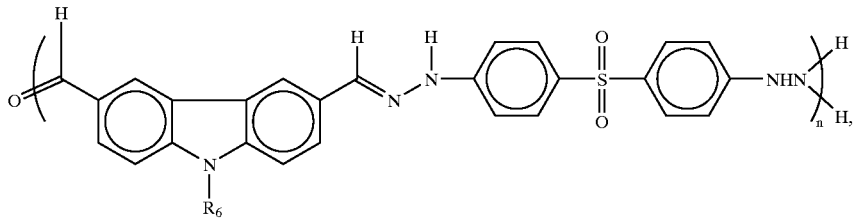

-continued

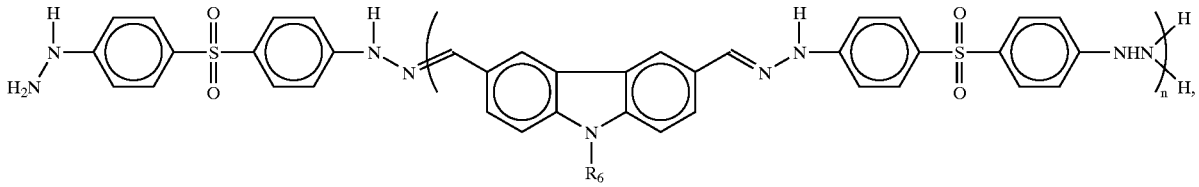

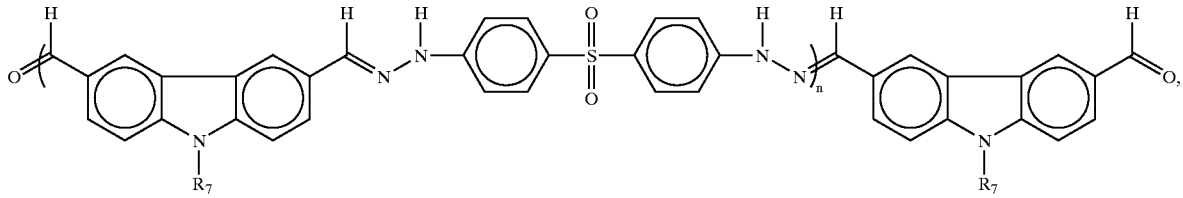

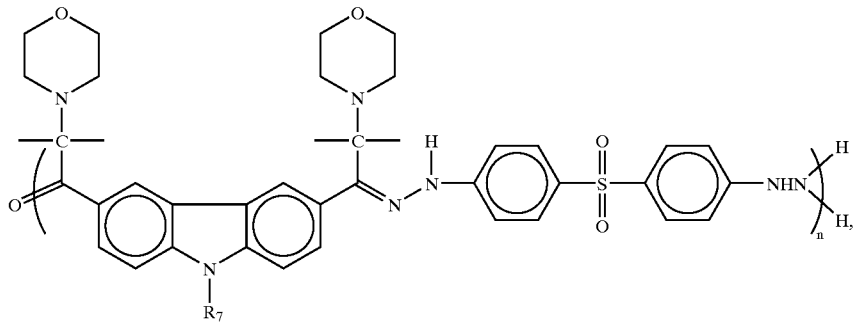

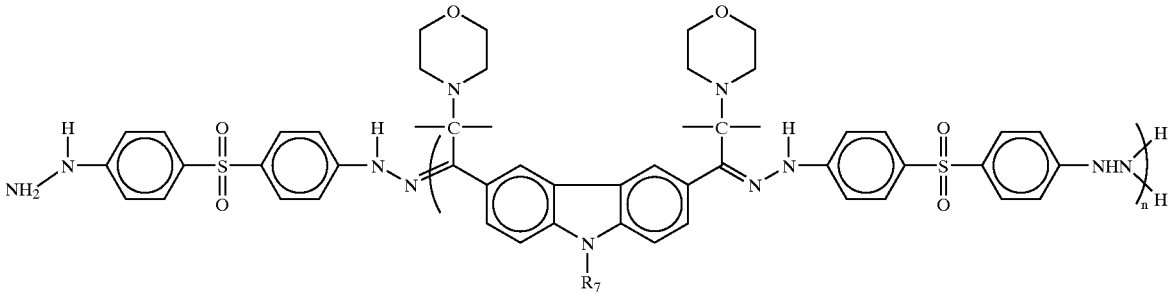

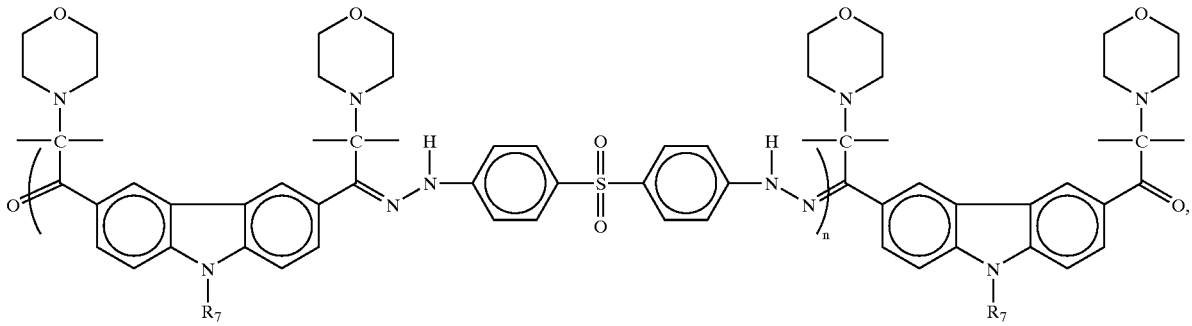

and their derivatives where the average n is between 1 and 1000 and $R_6$ and $R_7$ are, independently, hydrogen, a branched or linear alkyl group, a branched or linear unsaturated hydrocarbon group, an ether group, a cycloalkyl group, or an aryl group.

7. An organophotoreceptor according to claim 1 wherein X is a divalent biscarbazole alkane group.

8. An organophotoreceptor according to claim 1 wherein said charge transport composition comprises a compound with a formula selected from the group consisting of

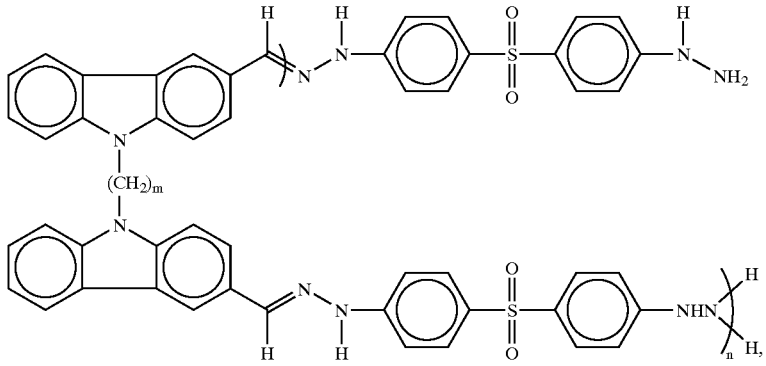

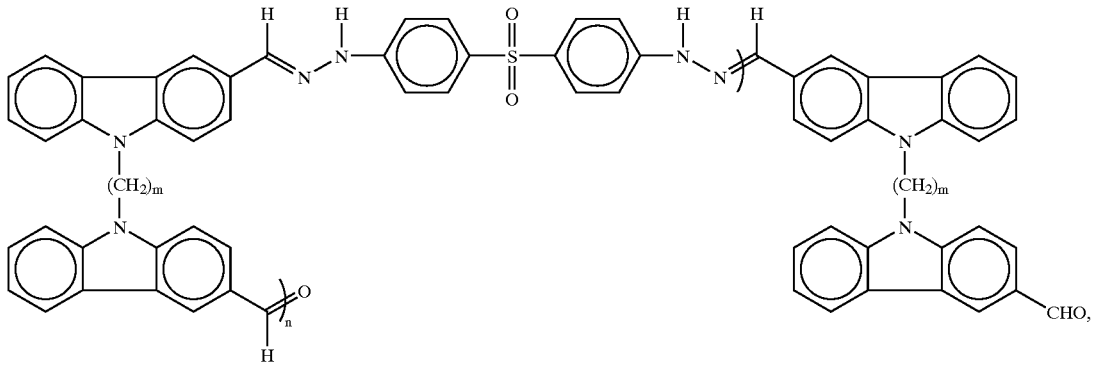

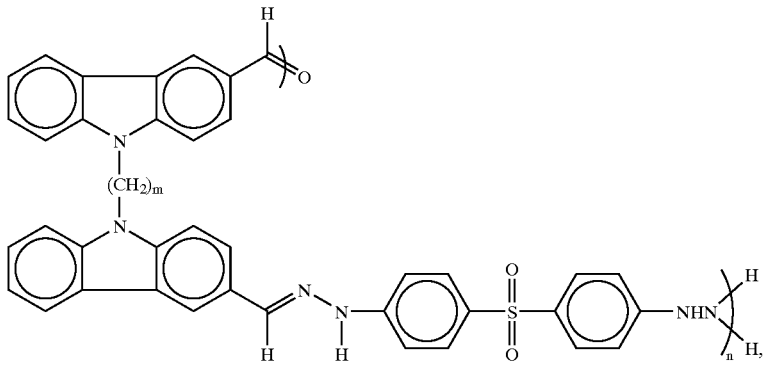

where the average n is between 1 and 1000 and m is between 2 and 30.

9. An organophotoreceptor according to claim 8 wherein m is between 5 and 12.

10. An electrophotographic imaging apparatus comprising:

(a) a plurality of support rollers; and (b) an organophotoreceptor operably coupled to said support rollers with motion of said support rollers resulting in motion of said organophotoreceptor, said organophotoreceptor comprising:

(i) a charge transport composition comprising molecules having the formula

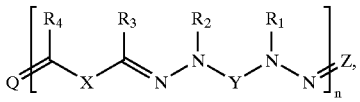

where the average n is between 1 and 1000;

$R_1$, $R_2$, $R_3$, and $R_4$ are, independently, hydrogen, a branched or linear alkyl group, a branched or linear unsaturated hydrocarbon group, an ether group, a cycloalkyl group, or an aryl group;

X is a divalent carbazole group or a divalent biscarbazole alkane group;

Y is a divalent sulfonyldiphenylene group;

Z is $C(R_4)—X—C(R_3)=O$ double-bonded to the adjacent N or two hydrogens where each hydrogen is independently single-bonded to the adjacent N; and Q is O or $N—N(R_1)—Y—N(R_2)—NH_2$;

(ii) a charge generating compound; and (iii) an electrically conductive substrate over which the charge transport composition and the charge generating compound are located.

11. An electrophotographic imaging apparatus according to claim 10 comprising a liquid toner dispenser.

12. An electrophotographic imaging process comprising:

(a) applying an electrical charge to a surface of an organophotoreceptor comprising:

(i) a charge transport composition comprising molecules having the formula

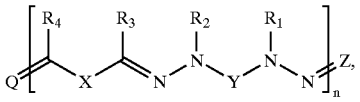

where the average n is between 1 and 1000;

$R_1$, $R_2$, $R_3$, and $R_4$ are, independently, hydrogen, a branched or linear alkyl group, a branched or linear unsaturated hydrocarbon group, an ether group, a cycloalkyl group, or an aryl group;

X is a divalent carbazole group or a divalent biscarbazole alkane group;

Y is a divalent sulfonyldiphenylene group;

Z is $C(R_4)—X—C(R_3)=O$ double-bonded to the adjacent N or two hydrogens where each hydrogen is independently single-bonded to the adjacent N; and Q is O or $N—N(R_1)—Y—N(R_2)—NH_2$;

(ii) a charge generating compound; and (iii) an electrically conductive substrate over which the charge transport composition and the charge generating compound are located;

(b) imagewise exposing said surface of said organophotoreceptor to radiation to dissipate charge in selected areas and thereby form a pattern of charged and uncharged areas on said surface;

(c) contacting said surface with a toner to create a toned image; and (d) transferring said toned image to a substrate.

13. An electrophotographic imaging process according to claim 12 comprising wherein the toner comprises liquid toner comprising a dispersion of colorant particles in an organic liquid.

14. A charge transport composition comprising molecules having the formula

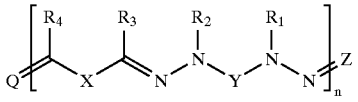

where the average n is between 1 and 1000;

$R_1$, $R_2$, $R_3$, and $R_4$ are, independently, hydrogen, a branched or linear alkyl group, a branched or linear unsaturated hydrocarbon group, an ether group, a cycloalkyl group, or an aryl group;

X is a divalent carbazole group or a divalent biscarbazole alkane group;

Y is a divalent sulfonyldiphenylene group;

Z is $C(R_4)—X—C(R_3)=O$ double-bonded to the adjacent N or two hydrogens where each hydrogen is independently single-bonded to the adjacent N; and Q is O or $N—N(R_1)—Y—N(R_2)—NH_2$.

15. A charge transport composition according to claim 14 wherein X is a divalent carbazole group.

16. A charge transport composition according to claim 14 wherein said charge transport composition comprises compounds having a formula selected from the group consisting of

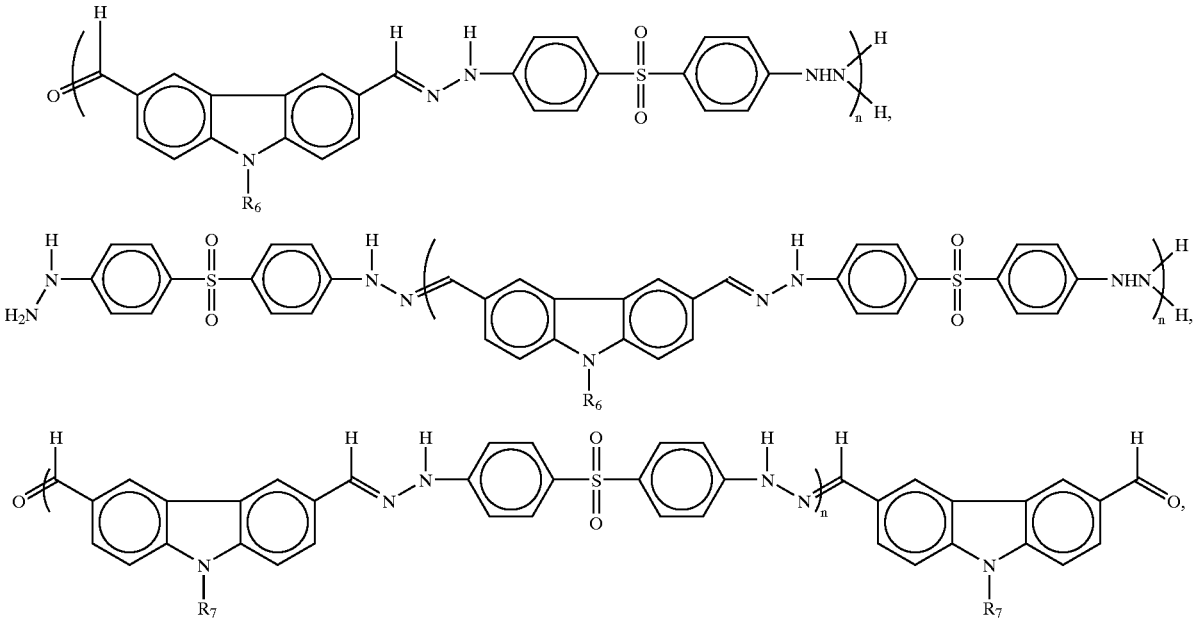

-continued

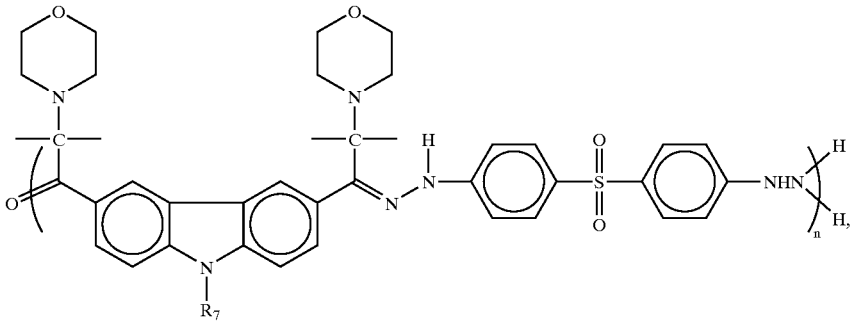

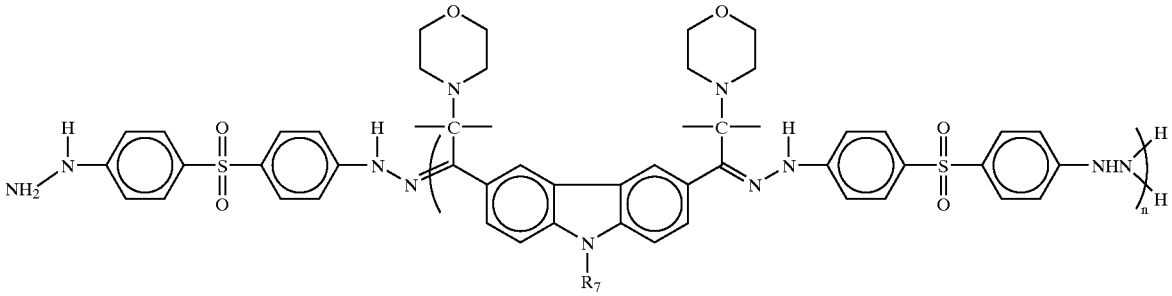

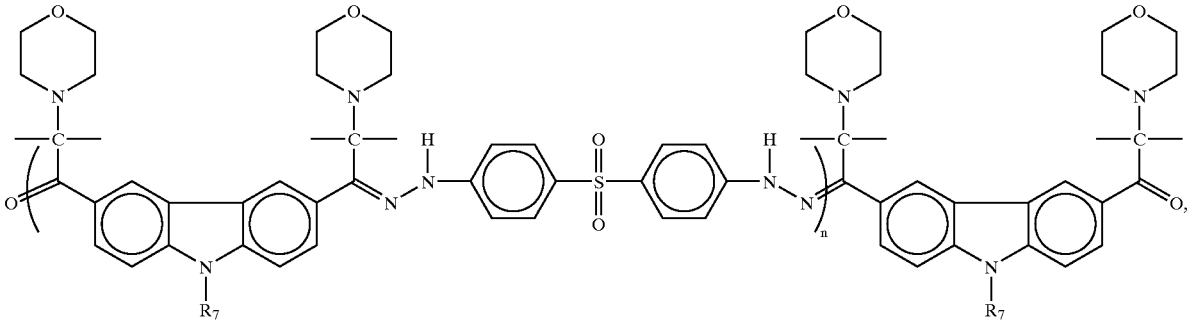

and their derivatives where the average n is between 1 and 1000 and $R_6$ and $R_7$ are, independently, hydrogen, a branched or linear alkyl group, a branched or linear unsaturated hydrocarbon group, an ether group, a cycloalkyl group, or an aryl group.

17. A charge transport composition according to claim 14 wherein X is a divalent biscarbazole alkane group.

18. A charge transport composition according to claim 14 wherein said charge transport composition comprises a compound with a formula selected from the group consisting of

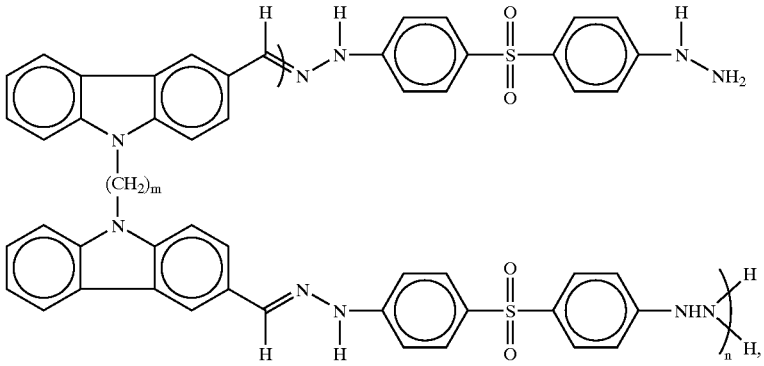

-continued
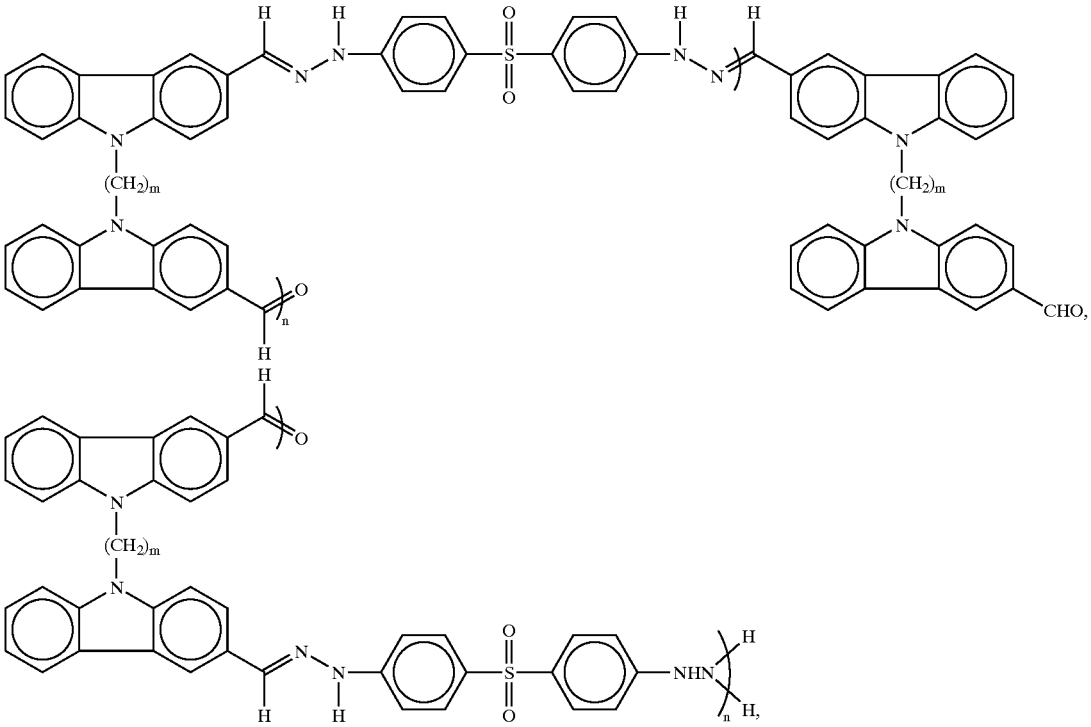
where the average n is between 1 and 1000 and m is between 2 and 30.
* * * * *